US005544792A

United States Patent [19]

Arnwine

[11] Patent Number: 5,544,792

[45] Date of Patent: Aug. 13, 1996

[54] CONVERTIBLE STUDENT BOOK BAG

[76] Inventor: Billy C. Arnwine, 16909 Old Colony Way, Rockville, Md. 20853

[21] Appl. No.: 300,959

[22] Filed: Sep. 6, 1994

[51] Int. Cl.[6] ..... A45F 4/02

[52] U.S. Cl. ..... 224/153; 224/580; 224/583; 224/584; 224/652; 224/657

[58] Field of Search ..... 224/151, 153, 224/209, 214, 235, 237, 259, 264; 190/109, 110, 115

[56] References Cited

U.S. PATENT DOCUMENTS

| | | | |
|---|---|---|---|
| 424,324 | 3/1890 | Marshall | 224/151 |
| 3,061,057 | 10/1962 | Miller | 190/110 |
| 3,443,671 | 5/1969 | Dyke | 190/110 |
| 3,622,056 | 5/1970 | Droeger | 224/209 |
| 4,081,061 | 3/1978 | Tucker | 190/52 |
| 4,169,550 | 10/1979 | Williams | 224/211 |
| 4,236,657 | 12/1980 | Brunton | 224/153 |
| 4,420,068 | 12/1983 | Gerch | 190/110 |
| 4,491,258 | 1/1985 | Jones | 224/153 |
| 4,609,084 | 9/1986 | Thomas | 224/153 |
| 4,655,343 | 4/1987 | Lane et al. | 224/153 |
| 4,884,731 | 12/1989 | Sibley | 224/215 |
| 4,887,751 | 12/1989 | Lehman | 224/151 |
| 4,901,897 | 2/1990 | Briggs et al. | 224/153 |
| 5,031,766 | 7/1991 | Cohen | 206/289 |
| 5,113,982 | 5/1992 | Pulichino et al. | 190/109 |
| 5,186,290 | 2/1993 | Takayama | 190/110 |

FOREIGN PATENT DOCUMENTS

| | | | |
|---|---|---|---|
| 237539 | 4/1945 | France | 224/209 |
| 4106925 | 11/1991 | Germany | 190/110 |

*Primary Examiner*—Henry J. Recla
*Assistant Examiner*—Charles R. Eloshway
*Attorney, Agent, or Firm*—Marvin L. Moore

[57] ABSTRACT

A book bag having a primary compartment and a plurality of substantially identical secondary compartments which are designed to function independently of each other while in a unitary arraignment. The compartments can be converted to a fully open relationship which allows for easy storage into narrow upright lockers. Each compartment has inner and outer parallel side panels connected by a bottom, top, and two ends. The compartments are interconnected in a side by side relationship to the side panel of a mating compartment by zipper elements. Secured to the inner panel of each compartment is a shoulder harness to allow the book bag to be carried in typical fashion on one's back. Individual compartments may also be carried by a handle secured to the top. Centrally positioned on the outer side panel is an expandable envelope designed for easy retrial of homework assignments or the like. Pockets are also provided on the ends of a compartment for storage of pens, rulers, pencils or other school supplies. Near the outer side panel along the ends and top extends a U-shaped closure means which when opened allows for entry within each compartment.

4 Claims, 4 Drawing Sheets

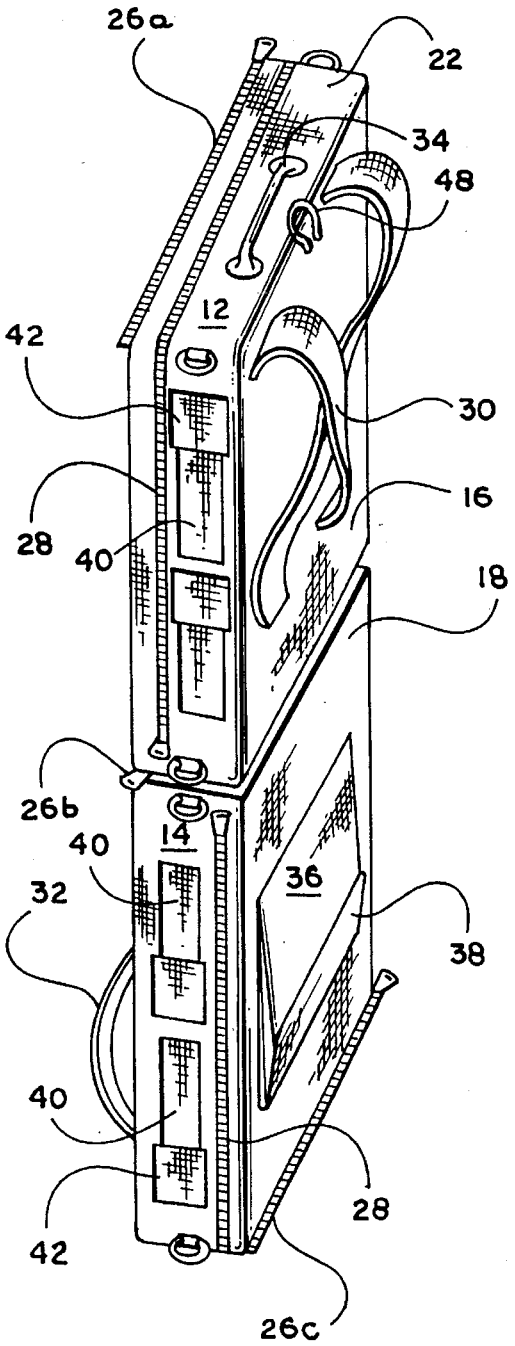
Fig. 3
Fig. 4
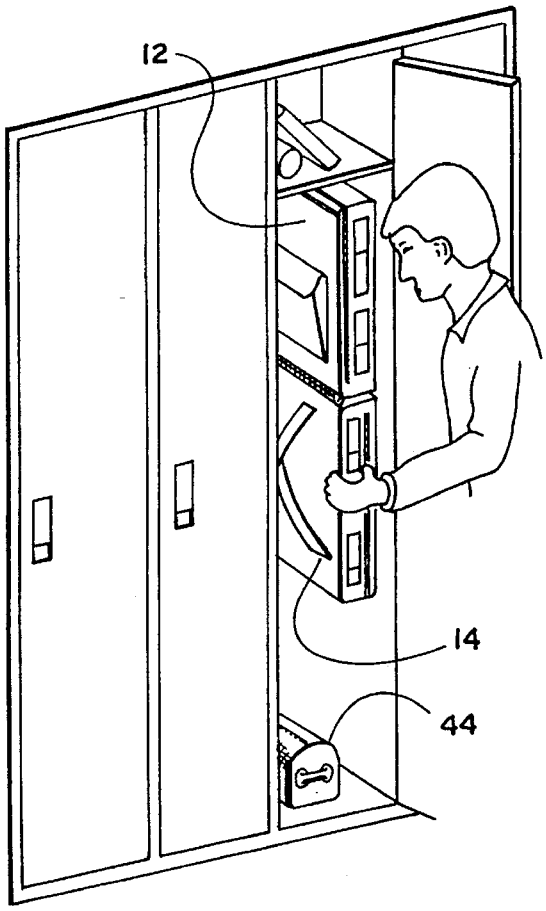

CONVERTIBLE STUDENT BOOK BAG

FIELD OF THE INVENTION

The present invention relates generally to carrying cases, and more particularly to a student book bag.

BACKGROUND OF THE INVENTION

Presently, students are in need of a carrying case for books and other school supplies designed to pass unincumbered through the narrow passage of school lockers. Conventional book bags once filled exceed the width provided by most school lockers. Consequently this provides for difficulty when trying to store such a bag in a locker for safe keeping. Typically a student must remove some of the bag's contents to allow such a bag to fit within a locker. Otherwise the book bag must be forced into the locker, thereby causing damage to the bag, it's contents, and possibly the locker as well. Similar damage is experienced upon retrieving said bag.

Furthermore, conventional book bags comprise a single storage compartment which contains the entire days supply of school material. This design adds to confusion when attempting to locate text and other material for a specified subject. Therefore, a book bag is also needed which provides a independent compartments for separating course material by subject matter.

U.S. Patents have issued for carrying cases used as garment bags and backpacks which include features to satisfy one or more of the above criteria.

U.S. Pat. No. 4,901,897 to Briggs et al. discloses a convertible garment bag constructed in the form of an elongated casing. The casing has a perimeter closure device to enable the carrying case to fold into multiple segments that interfasten to form a unitary compact for convenient transport by way of padded shoulder straps.

U.S. Pat. No. 4,081,061 to Tucker discloses a carrying case comprising a plurality of independent pieces capable of functioning independently of one another and each having fastening means for securing the separate pieces together as a unitary structure as desired while being stored or in use.

U.S. Pat. No. 4,491,258 to Jones discloses a convertible carrying case which comprises a back pack mode having a main storage element which has attached to either side a removable side storage element. Each side compartment includes a zipper which mates with a zipper on the side of the main storage element to allow for easy attachment and removal of the side elements.

The aforementioned U.S. patents are illustrative of the prior art carrying cases. Though prior art designs include features which satisfy one of more of the criteria of the present invention, no previous design fulfills all desired requirements. Accordingly, there continues to be a need for a carrying case for books and other school supplies which overcome the deficiencies of the prior art.

SUMMARY OF THE INVENTION

It is therefore an object of the present invention to provide a student book bag having independent compartments for separating course material by subject.

It is another object of the present invention to provide a student book bag having compartments which may be completely separated and used individually.

It is another object of the present invention to provide a student book bag which may receive additional auxiliary storage bags.

It is a further object of the present invention to provide a book bag which may be convened into a fully open relationship for easy access into narrow upright lockers.

The present invention provides a book bag having a plurality of substantially identical compartments which are designed to function independently of each other while in a unitary arrangement. Compartments can be used individually or they may be interconnected. Each compartment has inner and outer parallel side panels connected by a bottom, top, and two ends. The compartments are interconnected in a side by side relationship to the side panel of a mating compartment by way of zipper elements. Secured to the inner panel of each compartment is a shoulder harness to allow the book bag to be carried in typical fashion on ones back. Individual compartments may also be carried by a handle secured to the top. Centrally positioned on the outer side panel is an expandable envelope designed for easy retrieval of homework assignments or the like. Pockets are also provided on the ends of a compartment for the storage of pens, rulers pencils or other school supplies. Near the outer side panel along the ends and top extends a U-shaped closure means which when opened allows for entry within each compartment. Additionally, each compartment is fitted with metal D-rings which allow an array of auxiliary elements to be attached.

When the compartments are in an open relationship the book bag becomes elongated which allows for easy storage into narrow upright lockers. Once within the locker the bag may be hung on a hook by the loop hanger provided at the top of each compartment.

Other aspects, objects, features and advantages of the present invention will become apparent to those skilled in the art upon reading the detailed description of preferred embodiments in conjunction with the accompanying drawings and appended claims.

DESCRIPTION OF THE DRAWINGS

In the drawings, which are discussed below, the same reference numerals refer to the same features of the invention throughout the drawings. A student book bag according to a preferred embodiment of the invention is shown in FIGS. 1–7.

FIG. 3 represents a perspective view showing the primary compartment and a single secondary compartment in the fully opened embodiment.

FIG. 4 represents a perspective view showing the book bag of FIG. 3 fully opened and hanging in a student locker.

DETAILED DESCRIPTION

While the specification concludes with claims particularly pointing out and distinctly claiming the subject matter which is regarded as the invention, the invention will now be described by reference to the following description of a preferred embodiment taken in conjunction with the accompanying drawings.

Figure 1:
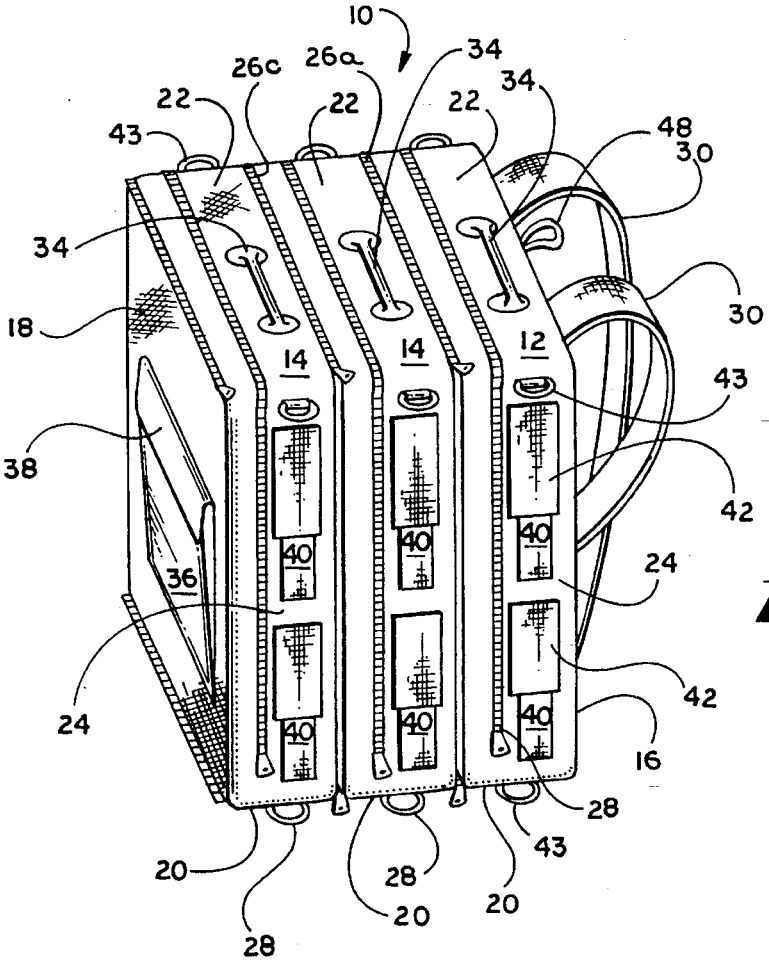
FIG. 1 represents a perspective view of the student book bag showing the primary compartment and two secondary compartments interconnected in accordance with an embodiment of the present invention.

Referring now to the drawings and more particularly to FIG. 1 there is shown a student book bag generally designated by numeral 10 and constituting one embodiment of the present invention. The present book bag 10 is generally made of a high quality, high strength nylon-like fabric having very great resistance to marring or tearing and comprising primary compartment 12 and secondary compartments 14. The compartments 12 and 14 are designed to function independently of each other while in a unitary arrangement. Each compartment 12, 14 is substantially identical and has a inner side panel 16 and an outer side panel 18 which are parallel to each other. Adjoining said side panels is a bottom 20, a top 22, and two ends 24 which are constructed from a single piece of fabric and sewn to the periphery of the inner 16 and outer 18 side panels with heavy duty thread.

Primary compartment 12 is distinguished from secondary compartments 14 in that it has a pair of padded shoulder straps 30 anchored to its inner side panel 16. In addition the primary compartment 12 has no zipper element 26 attached to inner side panel 16. Secondary compartments 14 comprise a single light weight shoulder strap 32 secured to their inner side panel 16. Shoulder straps 30 and 32 are adjustable in length to accommodate any user. A handle 34 is centrally located on top 22 of each compartment as an alternative means for carrying individual compartments. A U-shaped closure zipper 28 which extends about the ends 24 and top 22 of each compartment 12 and 14 allows access within said compartments.

An expandable envelope 36 is centrally attached to the outer panel 18 of each compartment and is large enough to accommodate letter size assignments, school supplies, and the like. It too is constructed from a high quality nylon-like fabric and sewn in place with heavy duty thread along the bottom and ends. A closure flap 38 is provided along the top which is kept shut by VELCRO or any other conventional means. Pockets 40 are provided along both ends 24 of each compartment and are designed to carry pens, pencil, rulers and the like. Each pocket 40 is provided with a pocket flap 42. In addition, each compartment 12 and 14 has metal D-rings 43 sewn in each of the four comers where the top 22 and bottom meet the side panels 16, and 18.

Primary 12 and secondary 14 compartments are attached in a side by side relationship with the outer panel 18 of one compartment facing the inner panel 16 of a mating compartment. The side panels of mating compartments have height and width dimensions which are substantially equal. A pair of zipper elements 26 are used to interconnect the compartments 12. Each of the zipper elements are used to interconnect primary 12 and secondary 14 compartments. Zipper elements 26*a*, 26*b*, 26*c*, 26*d* are positioned along the outer and inner edge of the top 22 and bottom 20 where the outer 18 and inner 16 side panels converge. It will be understood that each zipper element 26 has a slide attached to the outer side 18 of the primary 12 and secondary 14 compartments. In addition, secondary compartments 14 have the zipper element 26 mate attached to the inner side 16. Thus for example, when compartments 12, and 14 are placed side by side and interconnected the attaching zipper elements 26 properly mate.

Figure 2:
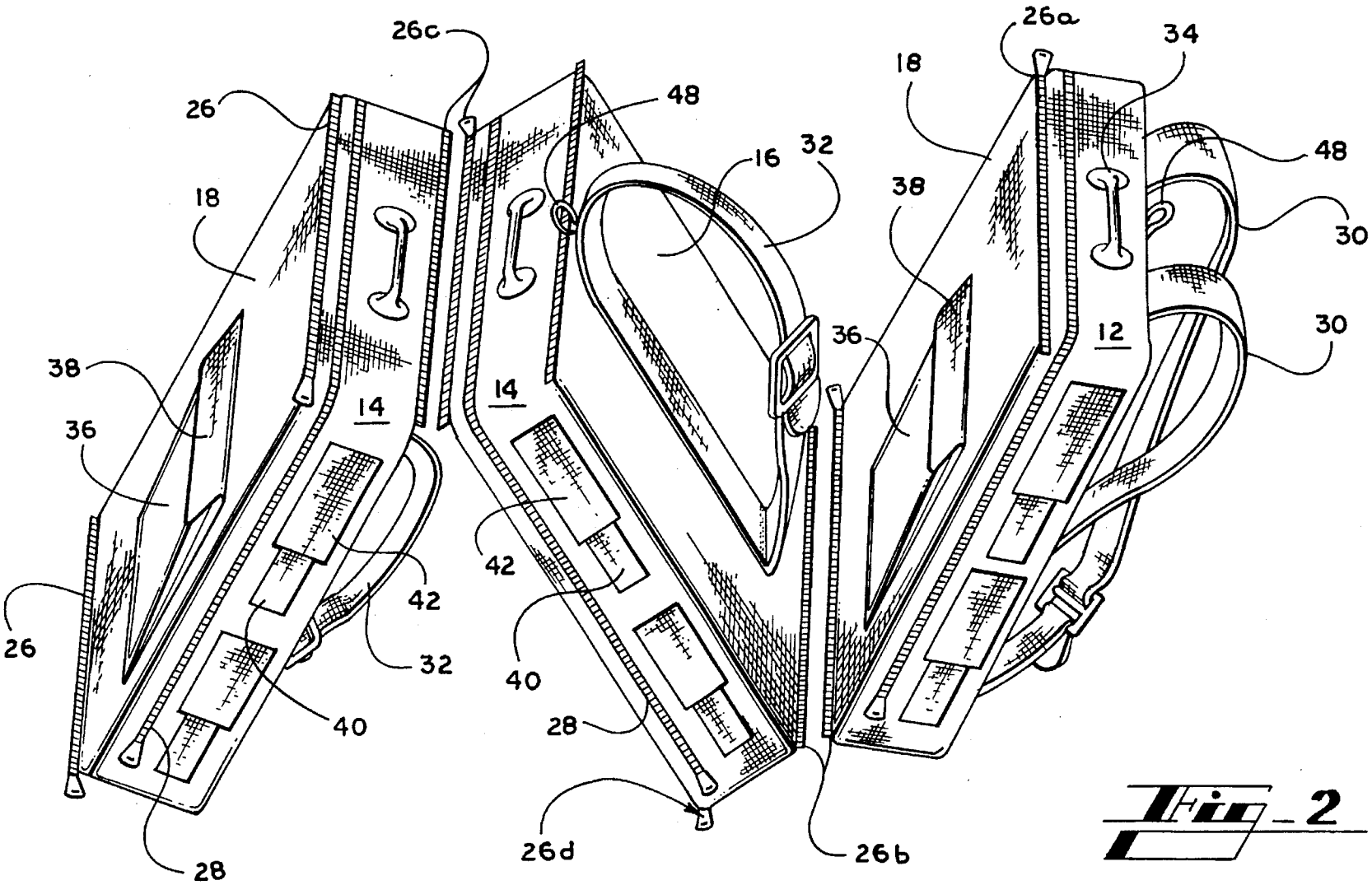
FIG. 2 represents a perspective view showing the book bag of FIG. 1 in a partially opened embodiment.

As shown in FIG. 2 the present invention can be converted into an opened relationship. When in a three compartment arrangement the opened relationship is achieved by unzipping zipper elements 26*a* and 26*d*. Once fully opened as shown in FIG. 3 the book bag 10 can pass with ease through the narrow opening of an elongated locker as shown in FIG. 4. Interconnected compartments 12, 14 can be separated and used individually by unzipping all attached zipper elements 26. Each compartment 12 and 14 is provided with a loop hanger 48 near the top 22 and on the inner panel 16 for hanging the book bag within the locker.

Figure 6:
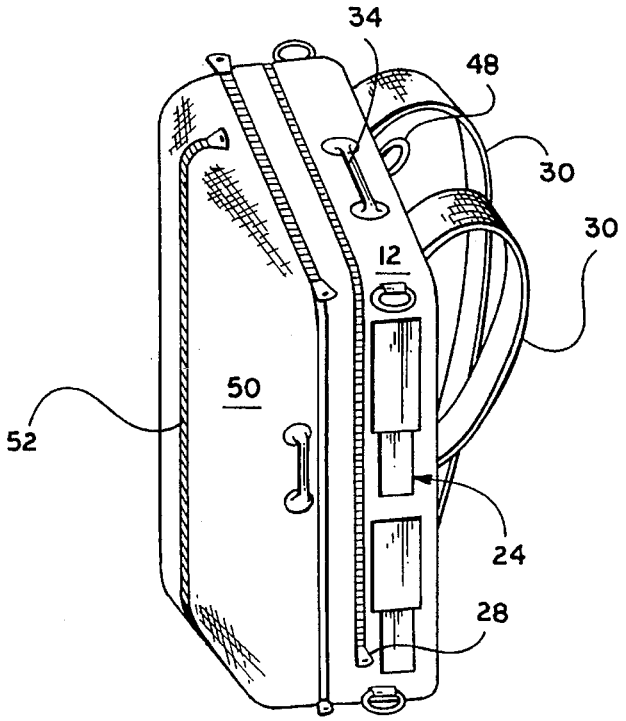
FIG. 6 represents a perspective view showing the primary compartment having an auxiliary element attachment on the outer side panel.
Figure 5:
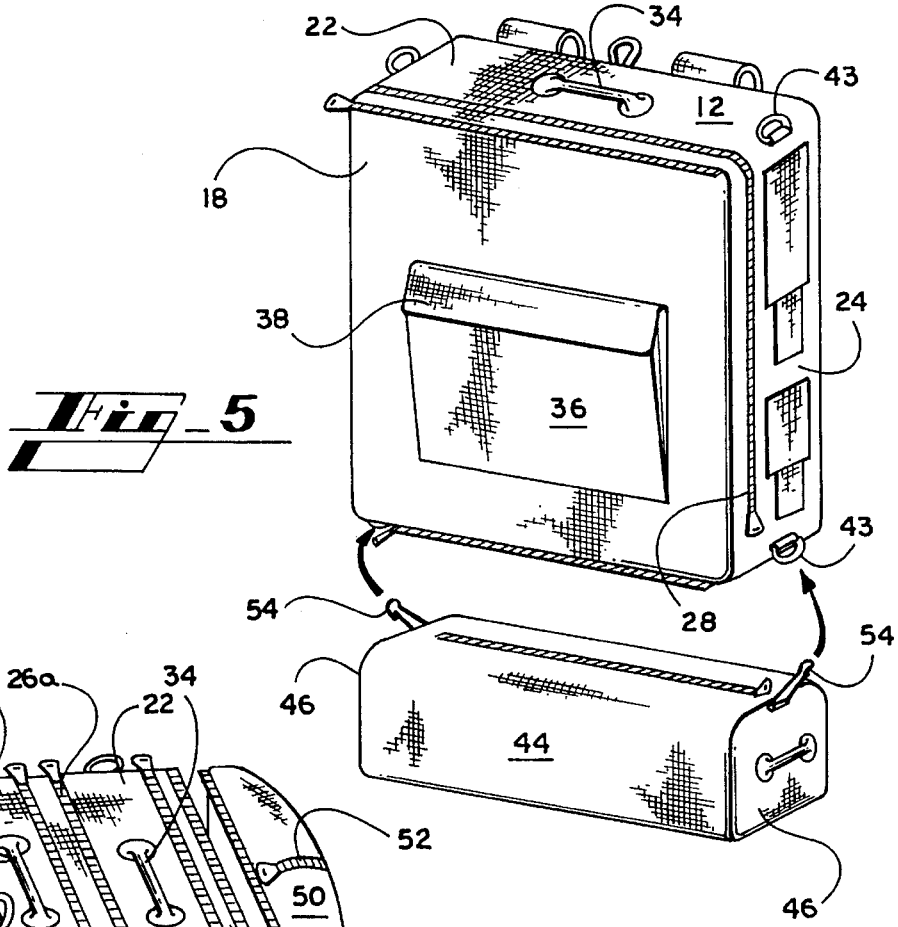
FIG. 5 represents a perspective view showing the primary compartment having an auxiliary element attached to the bottom.
Figure 7:
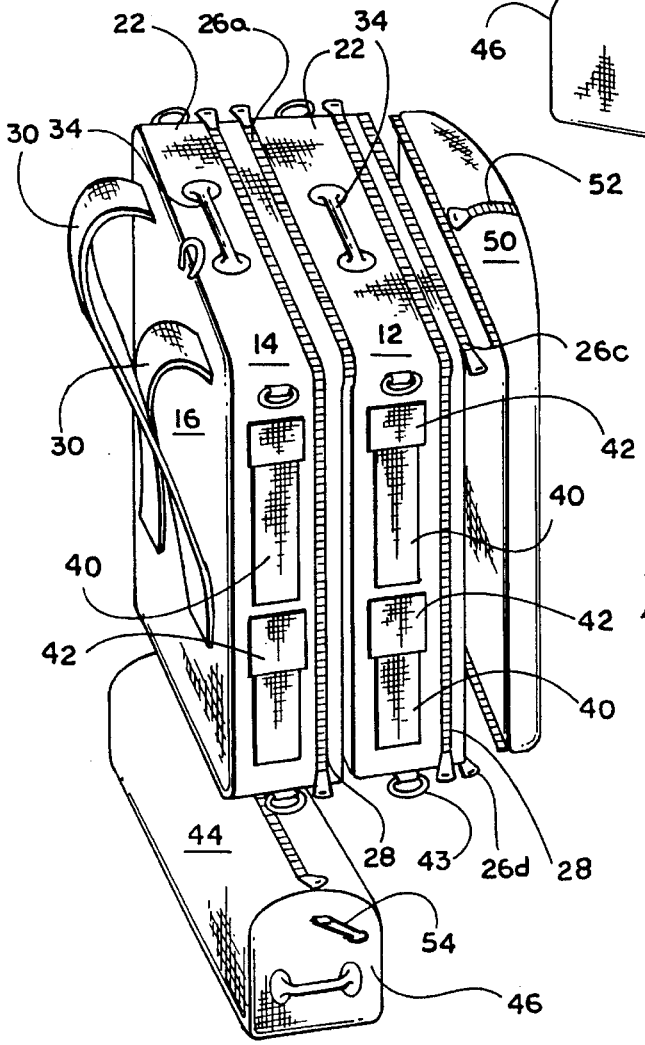
FIG. 7 represents a perspective view showing the primary compartment and a single secondary compartment interconnected with auxiliary attachments.

In accordance with additional embodiments shown in FIGS. 5, 6, and 7 the present invention may comprise a primary compartment and a plurality of secondary compartments as needed. In addition, auxiliary elements such as an auxiliary grip element 44 and auxiliary duffel element 50 may be attached to a compartment 12, 14. The grip element 44 has a generally tubular shape with two end faces 46. Attached to each end face 46 is a handle 34. The grip element 44 also has a means for attachment 54 to the D-rings 43 of a compartment 12, 14. The duffel element 50 has a generally arched shape with an inner panel 16 which mates to the outer panel 18 of a compartment 12, 14. Zipper elements 26 are provided on the duffel element 50 to allow it to interconnect with a compartment 12, 14. A centrally located vertical closure means 52 allows for entry into the duffle element 50.

As should be apparent from the foregoing specification, the invention is susceptible to being modified with various alterations and modifications which may differ from those which have been described in the preceding specification and description. Accordingly, the following claims are intended to cover all alterations and modifications which do not depart from the spirit of the invention.

LIST OF NUMBERS

This list is for convenience in referring to the drawings. It is not intended to be part of the patent application.

| | | | |
|---|---|---|---|
| 10 | Student Book Bag | 36 | Expandable Envelope |
| 12 | Primary Compartment | 38 | Closure Flap |
| 14 | Secondary Compartment | 40 | Pockets |
| 16 | Inner Side Panel | 42 | Pocket Flap |
| 18 | Outer Side Panel | 43 | Metal D-Ring |
| 20 | Bottom | 44 | Auxiliary Grip Element |
| 22 | Top | 46 | End Faces |
| 24 | Ends | 48 | Loop Hanger |
| 26 | Zipper Element | 50 | Auxiliary Duffel Element |
| 28 | U-Shaped Closure Means | 52 | Vertical Closure Means |
| 30 | Pair of Shoulder Straps | 54 | Attachment Means |
| 32 | Single Shoulder Strap | | |
| 34 | Handle | | |

What is claimed:

1. A convertible book bag comprising:

a primary compartment having an inner side panel with a pair of shoulder straps secured thereto and an outer side panel, wherein said side panels are bordered by a bottom, a top, and two end panels and further comprising zipper slide elements positioned along a top, and bottom border of said outer side panel;

a secondary compartment having an inner side panel with a single shoulder strap secured thereto and an outer side panel, wherein said side panels are bordered by a bottom, a top, and two end panels and comprising zipper slide elements positioned along a top and bottom border of said outer side panel and further comprising zipper mating elements positioned along a top and bottom border of said inner side panel by mating with said zipper slide elements of the primary compartment, said shoulder strap positioned on said inner side panel such that it is concealed by said outer side panel of said primary compartment when said primary compartment is zipped to said secondary compartment;

whereby, said primary and secondary compartments may be converted into a fully opened relationship by unzipping the zipper slide element along the top of said primary compartment.

2. The convertible book bag of claim 1 wherein a plurality of secondary compartments may be sequentially interconnected to each other.

3. The convertible book bag of claim 1 wherein said interconnected compartments may be separated and used individually by unzipping zipper elements.

4. The convertible book bag of claim 1 wherein each compartment has a closure zipper connected around the ends and top of each compartment.

* * * * *